United States Patent [19]

Tervola

[11] Patent Number: 5,070,563

[45] Date of Patent: Dec. 10, 1991

[54] TOOL BEARING RINGS

[76] Inventor: Pentti J. Tervola, 3663 Lakewood Rd., Lake Worth, Fla. 33461

[21] Appl. No.: 480,230

[22] Filed: Feb. 15, 1990

Related U.S. Application Data

[63] Continuation-in-part of Ser. No. 249,770, Sep. 26, 1988, Pat. No. 4,905,335.

[51] Int. Cl.[5] ..... B25F 1/00

[52] U.S. Cl. ..... 7/169; 7/170; 7/165; 7/901; 7/151; 81/3.09; 30/298; 294/25; 294/65.5

[58] Field of Search ..... 7/121, 165, 170, 169, 7/901, 151; 81/3.09, 3.55, 3.07, 436, 439; 30/298, 232, DIG. 8; 294/25, 65.5; 70/413, 276

[56] References Cited

U.S. PATENT DOCUMENTS

| | | | |
|---|---|---|---|
| 2,176,052 | 10/1939 | Beyer | 294/65.5 |
| 2,585,641 | 2/1952 | Faso | 294/65.5 |
| 2,735,321 | 2/1956 | Brown et al. | 81/436 |
| 3,837,195 | 9/1974 | Pelto | 70/413 |
| 4,022,038 | 5/1977 | Miller | 70/413 |
| 4,077,242 | 3/1978 | Sedley | 70/413 |
| 4,079,606 | 3/1978 | Svihovec | 70/407 |
| 4,174,620 | 11/1979 | Russell | 294/25 |
| 4,332,178 | 6/1982 | Vukich | 81/436 |
| 4,658,612 | 4/1987 | Eisermann | 70/413 |
| 4,667,544 | 5/1987 | Milo | 7/151 |

FOREIGN PATENT DOCUMENTS

| | | | |
|---|---|---|---|
| 33541 | 8/1924 | Denmark | 30/298 |
| 178741 | 3/1962 | Sweden | 294/25 |
| 1237408 | 6/1986 | U.S.S.R. | 81/436 |

*Primary Examiner*—Roscoe V. Parker
*Attorney, Agent, or Firm*—Alvin S. Blum

[57] ABSTRACT

A device in the form of a ring for wearing on a finger bears a variety of implements including the magnetic pick-up for engaging ferromagnetic objects. It may include other tools such as screwdriver blades, line cutters, prying claws, glass cutters and the like for convenience in having certain useful tools at hand when needed without encumbering the hands of the user. The tools are arranged in a line along the circumference of the device. Also described is a set of magnets arranged in a particular configuration and polarity to unlock a magnetic lock.

9 Claims, 1 Drawing Sheet

FIG. 1
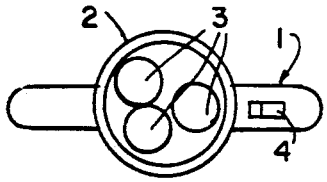
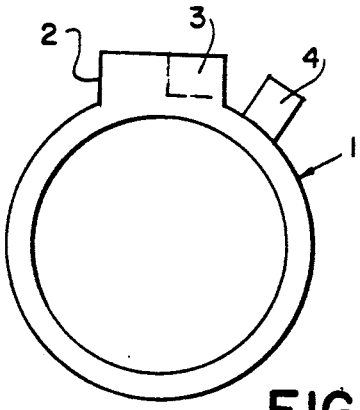
FIG. 2
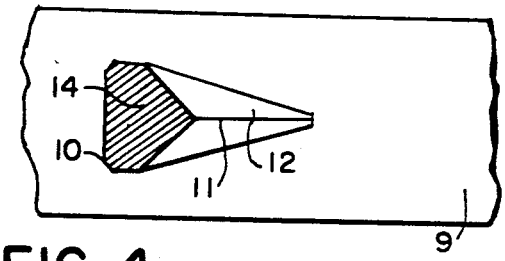
FIG. 4
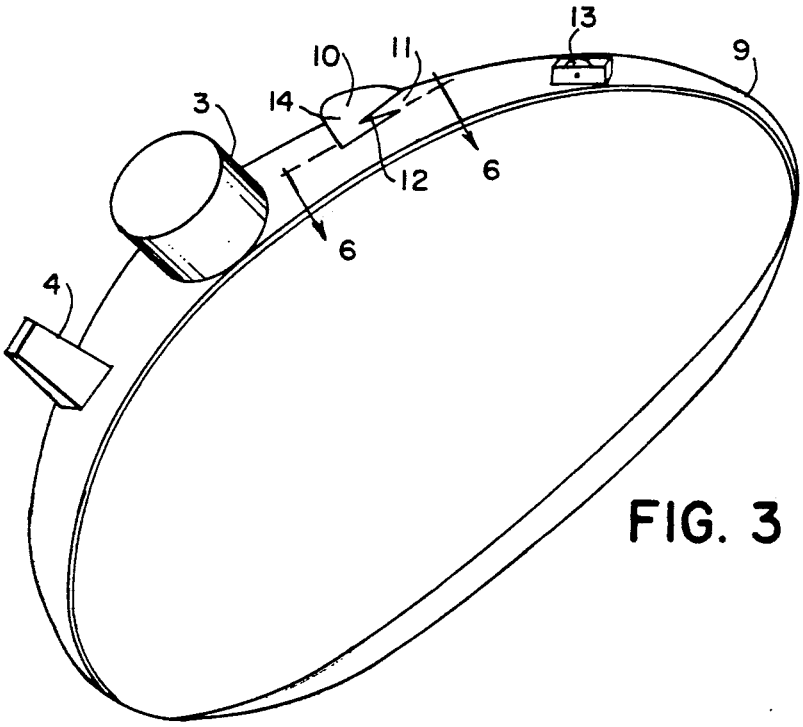
FIG. 3
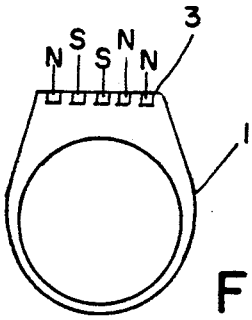
FIG. 5
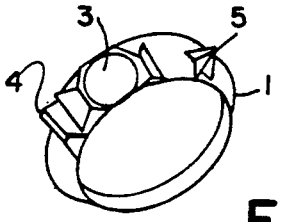
FIG. 6

TOOL BEARING RINGS

This invention is a continuation-in-part of copending application Ser. No. 07/249,770, and now Pat. No. 4,905,335 filed Sep. 26, 1988.

This invention relates to rings, and more particularly to such devices that incorporate a magnetic element for engaging ferromagnetic materials and other useful tools such as screw driver elements, line cutters and the like.

BACKGROUND OF THE INVENTION

It is very useful for a worker to have rapid and convenient access to a magnet for picking up small objects, removing metal splinters, identifying metals, holding papers against a metal object and the like. However most workers will not bother to carry a magnet about because it is so infrequently used. Because it is not at hand when needed, they lose the many advantages of a magnet. The same may be said of other tools that are not very large, but would be inconvenient to carry about, such as screwdrivers and line cutters. Many individuals find it less objectionable to wear an article of adornment such as a ring, because the hands are left free.

U.S. Pat. Nos. 1,174,887 issued Mar. 7, 1916, to Meriwether and 4,174,620 issued Nov. 20, 1979, to Russell teach rings with a central magnet and 2,176,052 issued Oct. 17, 1939, to Beyer teaches a bracelet with a central magnet.

The following U.S. patents teach a ring with a single tool thereon:

U.S. Pat. No. 4,667,544 issued May 26, 1987, to Milo
U.S. Pat. No. 2,735,321 issued Feb. 21, 1956, to Browne et al.
U.S. Pat. No. 2,585,641 issued Feb. 12, 1952, to Faso
U.S. Pat. No. 885,580 issued May 26, 1908, to Brinn
U.S. Pat. No. 1,649,699 issued Nov. 15, 1927, to Irvine
U.S. Pat. No. 1,521,051 issued Dec. 30, 1924, to Shiba
U.S. Pat. No. 107,016 issued Sep. 6, 1870 to Egge et al.
also Danish No. 33,541 issued Aug. 4, 1924, to Osterholt
USSR No. 1237408A issued Jun. 15, 1986, to Baltabaev A finger wrench assembly in which a single tool on a holder is removably connected to a finger encircling base assembly is taught by Vukich in U.S. Pat. No. 4,332,178 issued Jun. 1, 1982. To use another tool, the first holder is removed from the base assembly and replaced by another.

In all of the above teaching, to use more than one tool, a supply of different devices must be kept close by. It would be awkward to routinely carry such a supply around.

SUMMARY OF THE INVENTION

It is accordingly an object of the invention to provide an article worn by the user comprising a closed, rigid ring having a cylindrical hole therethrough that incorporates a magnet means for use in engaging ferromagnetic materials.

It is a further object of the invention to provide such a ring in combination with one or more screwdriver bits constructed for direct use without the need for additional members such as handles.

It is yet another object to provide such a ring in combination with a hook that may serve as a line cutter, bottle and can opener, or ripping claw.

It is yet another object to provide a ring with cutters, openers or claws and the like made in one piece without moving parts.

Screwdrivers, line cutters and the like may be formed in one piece with said band such as by casting, or may be attached by conventional means.

It is yet another object to provide such a ring in combination with one or more of the following accessories: screwdriver bits; magnet means; line cutter; container opener; claws; glass cutter.

It is yet another object to provide such a ring with a series of magnets arranged in coded order for unlocking a magnetic lock.

It is yet another object to provide a ring with a screw holding magnet in combination with a screw driving bit for a slotted screw and a screw driving bit for a cross-slotted screw, so that the fastener holder and fastener drivers may all be conveniently at hand without changing tools or rings.

It is yet another object that the tools be arranged in a line along the circumference of the ring, for enhanced operation and economy of manufacture.

BRIEF DESCRIPTION OF THE DRAWINGS

FIG. 1 is a plan view of a ring of the invention with a plurality of magnets in the center and a straight blade screwdriver on one side.

FIG. 2 is a front elevation view of the ring of FIG. 1.

FIG. 3 is a perspective view of a ring combining magnet, line cutter, screwdriver, and glass cutter.

FIG. 4 is a cross section through 6—6 of FIG. 3.

FIG. 5 is a front elevation of a ring with magnetic key.

FIG. 6 is a perspective view of a ring including magnet, and screwdrivers.

DETAILED DESCRIPTION OF PREFERRED EMBODIMENTS

Referring now first to FIGS. 1 and 2, a non-magnetic stainless steel ring 1 has a cylindrical member 2 holding three short cylindrical magnets 3 one of which is shown in phantom in FIG. 2. On one side of the ring, a screwdriver blade 4 for a slotted screw is mounted for convenient use as a screwdriver or a prying tool with the ring serving as a handle. The screwdriver function can be operated with the ring on the finger or holding the ring between the fingers as needed.

FIG. 3 shows a ring 9 on which is mounted a cylindrical magnet 3, a straight screwdriver blade 4 and a hook or claw 10 with a tapered gap 11 that may be used as a claw or hook for lifting tabs, bottle caps, and the like. The gap 11 may be provided with a sharpened inner region 12 for cutting whatever is fitted into the gap 11 such as cans, fishing line, twine or thread. The device that may be positioned wherever it will function most effectively. For example, the claw may be located to fit between the fingers to prevent inadvertent snagging of objects. A cutter 13 for cutting glass, paper and the like may also be attached to ring 1.

As illustrated in FIG. 3 and the cross sectional detail of FIG. 4, the hook or claw 10 is made in one piece without moving parts, with a narrow body 14 tapering to a sharp edge at the gap 12. This structure has been found to be especially effective for cutting cord, thread, fishing line and the like by forming a loop in the cord and pulling the bight of the loop into gap 12 against the sharpened edges. As shown in FIG. 6, the body 14 forms what is effectively a knife edge at the apex of the sharp V-shaped gap.

The ring for encircling the finger takes the form of a continuous, closed, circular, rigid band as shown in FIGS. 2, 3, 5, 6 in which the central, axial hole therethrough has a cylindrical wall for comfortable fit on the finger as is well known in the art.

There are numerous locks well known in the art that can only be opened by application of a magnetic key comprised of a plurality of small magnets arranged in a particular distribution and polarity that constitutes a code for unlocking a particular lock. FIG. 7 shows a ring 1 bearing such a key in the form of a plurality of magnets 3 having indicated polarities N for north and S for south at their uppermost ends. A thin cover may conceal the magnets if desired.

FIG. 6 shows a ring 1 including a magnet 3, screwdriver bits 5 and 4 and a claw hook including a line cutter 10. Construction materials may include various metals, plastics, precious stones and the like for enhanced function and appearance.

It has been found that the various implements, when attached to the ring in a line along the circumference, as shown, are easier to use and more economical to manufacture.

The manner of construction of these devices is well known in the jewelry and metal working art and may take the many alternative forms that these devices have been known to take for an attractive and comfortable accessory that will serve useful as well as decorative functions.

The above disclosed invention has a number of particular features which should preferably be employed in combination although each is useful separately without departure from the scope of the invention. While I have shown and described the preferred embodiments of my invention, it will be understood that the invention may be embodied otherwise than an herein specifically illustrated or described, and that certain changes in the form and arrangement of parts and the specific manner of practicing the invention may be made within the underlying idea or principles of the invention within the scope of the appended claims.

I claim:

1. A ring to be worn on a finger including:

a plurality of individual magnets arranged on said ring in a sequence and polarity for functioning as a magnetic key for unlocking a lock responsive to said sequence and polarity arrangement; and glass cutter means for cutting glass, said glass cutter means securely connected to said ring.

2. A ring to be worn on a finger, said ring including at least two screwdriver means for engaging the head of a screw, said screwdriver means having a solid base affixed to said ring at an imperforate area of said ring for turning said screw by turning said ring, said screwdriver means arranged substantially in a line along the circumference of said ring; and further including magnet means for magnetically engaging ferromagnetic materials, said magnetic means attached to said ring and arranged with said screwdriver means substantially in a line along the circumference of said ring.

3. The ring according to claim 2 further including: cord cutter means for cutting filamentous material; a glass cutter; and a container opener attached to said ring and arranged with said screwdriver means substantially in a line along said circumference.

4. The ring according to claim 2 further including a cord cutter means for cutting filamentous material and a container opener attached to said ring and arranged with said screwdriver means substantially in a line along said circumference.

5. A ring to be worn on a finger, said ring including at least two screwdriver means for engaging the head of a screw, said screwdriver means having a solid base affixed to said ring at an imperforate area of said ring for turning said screw by turning said ring, said screwdriver means arranged substantially in a line along the circumference of said ring; and further including a cord cutter means for cutting filamentous material, said cutter means attached to said ring and arranged with said screwdriver means substantially in a line along the circumference of said ring.

6. The ring according to claim 5 further including: a glass cutter; and a container opener attached to said ring and arranged with said screwdriver means substantially in a line along said circumference.

7. The ring according to claim 5 further including: a container opener attached to said ring and arranged with said screwdriver means substantially in a line along said circumference.

8. A ring to be worn on a finger, said ring including at least two screwdriver means for engaging the head of a screw, said screwdriver means having a solid base affixed to said ring at an imperforate area of said ring for turning said screw by turning said ring, said screwdriver means arranged substantially in a line along the circumference of said ring; and further including a glass cutter connected to said ring and arranged with said screwdriver means substantially in a line along the circumference of said ring.

9. A ring to be worn on a finger, said ring including at least two screwdriver means for engaging the head of a screw, said screwdriver means having a solid base affixed to said ring at an imperforate area of said ring for turning said screw by turning said ring, said screwdriver means arranged substantially in a line along the circumference of said ring; and further including a container opener connected to said ring and arranged in a line with said screwdriver means along said circumference.

* * * * *